US008246395B2

(12) United States Patent
Vino, IV et al.

(10) Patent No.: US 8,246,395 B2
(45) Date of Patent: Aug. 21, 2012

(54) CONTACT FOR AN ELECTRICAL CONNECTOR

(75) Inventors: Michael Joseph Vino, IV, Landisville, PA (US); Edward Eugene Knisely, Jr., Middletown, PA (US)

(73) Assignee: Tyco Electronics Corporation, Berwy, PA (US)

( * ) Notice: Subject to any disclaimer, the term of this patent is extended or adjusted under 35 U.S.C. 154(b) by 13 days.

(21) Appl. No.: 12/879,815

(22) Filed: Sep. 10, 2010

(65) Prior Publication Data

US 2012/0064773 A1 Mar. 15, 2012

(51) Int. Cl.
*H01R 13/02* (2006.01)

(52) U.S. Cl. ..... 439/884

(58) Field of Classification Search ..... 439/733.1, 439/869, 877, 585

See application file for complete search history.

(56) References Cited

U.S. PATENT DOCUMENTS

| | | | | | |
|---|---|---|---|---|---|
| 4,114,975 | A * | 9/1978 | Weidler | 439/626 |
| 5,088,934 | A * | 2/1992 | Chow et al. | 439/395 |
| 5,597,330 | A * | 1/1997 | Hatagishi | 439/752 |
| 5,709,565 | A * | 1/1998 | Okamoto | 439/395 |
| 5,772,464 | A * | 6/1998 | Hohorst | 439/395 |
| D409,142 | S * | 5/1999 | Yoshiura | D13/133 |
| 6,315,588 | B1 * | 11/2001 | Heberlein et al. | 439/188 |
| 6,899,566 | B2 * | 5/2005 | Kline et al. | 439/607.56 |
| 7,241,150 | B2 * | 7/2007 | Aihara | 439/885 |

* cited by examiner

*Primary Examiner* — Briggitte R Hammond

(57) ABSTRACT

An electrical contact is provided. The contact includes a mating end, a mounting end, and an intermediate portion extending between the mating end and the mounting end. A shield attachment area is located on the intermediate portion. The shield attachment area has a top, a bottom, and a pair of sides extending between the top and the bottom. A notch is formed in at least one of the top or the bottom of the shield attachment area. The notch is configured to align the pair of sides during stamping and forming of the shield attachment area. The notch aligns the pair of sides such that the sides are stamped and formed in a substantially parallel configuration.

20 Claims, 4 Drawing Sheets

CONTACT FOR AN ELECTRICAL CONNECTOR

BACKGROUND

The subject matter described herein relates generally to electrical connectors and, more particularly, to contacts for electrical connectors.

Circuit boards generally include electrical headers that are configured to receive a card module or the like. The electrical header includes a dielectric housing having contacts extending therethrough. The contacts include a mounting end and a mating end. The mounting end joins to the circuit board to electrically couple the electrical header to the circuit board. The mating end is configured to engage and electrically couple to the card module. An intermediate portion extends between the mounting end and the mating end. The intermediate portion is configured to be over-molded with insulation. The insulation controls electromagnetic interference within the dielectric housing. The insulation also creates an interference fit to retain the contact within the dielectric housing. Some electrical headers include a shield which extends along the intermediate portions of the contacts. The shield is joined to a shield attachment area of the contacts. The shield attachment area is not over-molded within insulation. Leaving the shield attachment area exposed provides an electrical connection between the shield attachment area and the shield.

The contacts are typically stamped and formed in a press. The shield attachment area is formed by opposing walls of the press. In particular, the walls are pushed together to form parallel sides of the shield attachment area. The mounting end and the mating end are formed by a similar process. The intermediate portion of the contact is then over-molded with insulation. During the over-molding process, the shield attachment area is isolated from the insulation with panels formed in the mold. Isolating the shield attachment area prevents the shield attachment area from being insulated. Accordingly, the shield attachment area remains exposed after the over-molding process.

However conventional contacts are not without their disadvantages. During the stamping and forming process, the sides of the shield attachment area may be formed unevenly. Specifically, a top of the shield attachment area may have a width greater than the width of a bottom of the shield attachment area. The sides of the shield attachment area flare outward from the bottom to the top. When the shield attachment area is non-uniformly formed, complications may arise during the over-molding process. For example, the flared sides of the shield attachment area may create a gap between the shield attachment area and the panel of the mold used, in the over-molding process. During the over-molding process, insulation may seep through the gap and into the isolated shield attachment area, thereby causing flashing. The flashing results in unwanted strips of insulation being formed on the shield attachment area. Generally, the unwanted strips of insulation are difficult to remove and the contact must be discarded.

A need remains for a contact having a shield attachment area that can be isolated from insulation during an over-molding process.

SUMMARY OF THE INVENTION

In one embodiment, an electrical contact is provided. The contact includes a mating end, a mounting end, and an intermediate portion extending between the mating end and the mounting end. A shield attachment area is located on the intermediate portion. The shield attachment area has a top, a bottom, and a pair of sides extending between the top and the bottom. A notch is formed in at least one of the top or the bottom of the shield attachment area. The notch is configured to align the pair of sides during stamping and forming of the shield attachment area. The notch aligns the pair of sides such that the sides are stamped and formed in a substantially parallel configuration.

In another embodiment, an electrical header is provided. The electrical header includes a housing having a mounting end and a mating end. A plurality of electrical contacts extends through the dielectric housing. Each of the plurality of contacts includes a mating end, a mounting end, and an intermediate portion extending between the mating end and the mounting end. A shield attachment area is located on the intermediate portion. The shield attachment area has a top, a bottom, and a pair of sides extending between the top and the bottom. A notch is formed in at least one of the top or the bottom of the shield attachment area. The notch is configured to align the pair of sides during stamping and forming of the shield attachment area. The notch aligns the pair of sides such that the sides are stamped and formed in a substantially parallel configuration.

In another embodiment, an electrical connector is provided. The connector includes a housing holding at least one contact which has been manufactured by stamping from sheet material. The at least one contact has an exposed portion which is external to the housing. The exposed portion has a top, a bottom, and a pair of sides extending between the top and the bottom. The exposed portion has a notch in at least one of the top and the bottom. The notch is formed during the stamping and is configured such that the pair of sides are substantially parallel to each other along a length of the notch.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
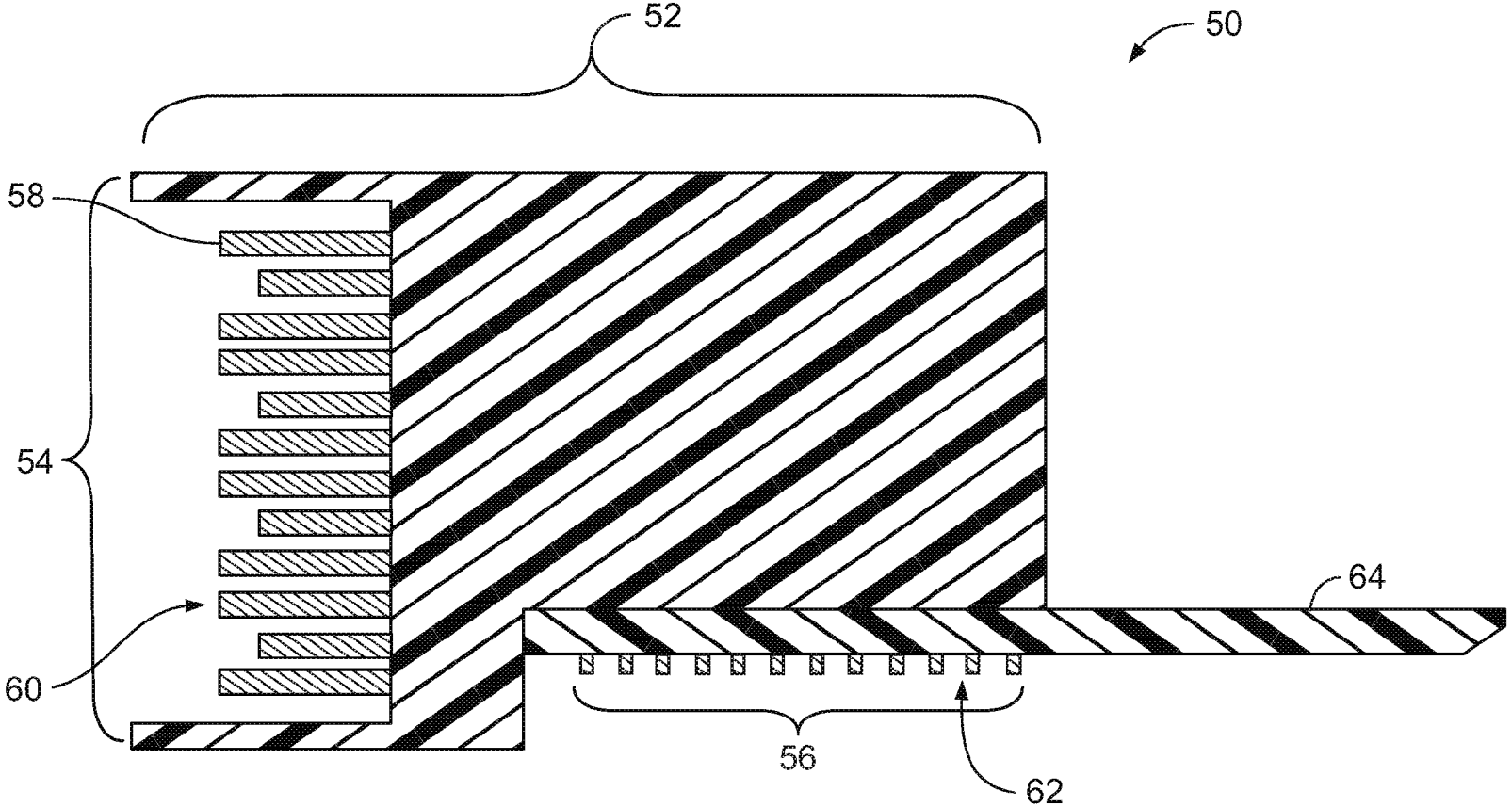
FIG. 1 is a side cross-sectional view of an electrical header formed in accordance with an embodiment.

FIG. 1 illustrates an electrical header 50 formed in accordance with an embodiment. The electrical header 50 includes a housing 52 having a mating end 54 and a mounting end 56 oriented at an angle, for example, 90 degrees with respect to the mating end 54. The housing 52 may be formed from a dielectric material. A plurality of contacts 58 extend through the housing 52. The contacts 58 include a mating end 60 extending from the mating end 54 of the housing 52 and a mounting end 62 extending from the mounting end 56 of the housing 52.

The electrical header 50 is joined to a circuit board 64. The mounting end 56 of the housing 52 may be disposed on the circuit board 64. The mounting end 62 of each contact 58 is joined to the circuit board 64 to electrically join the electrical header 50 and the circuit board 64. The mounting end 62 of each contact 58 may be through-hole mounted into apertures formed in the circuit board 64, such that the mounting end 62 of each contact 58 extends through the circuit board 64. The mating end 54 of the electrical header 50 is configured to engage a corresponding contact of a module (not shown), for example, a card module. The electrical header 50 joins the module to the circuit board 64 such that the module and the circuit board 64 are electrically engaged.

Figure 2:
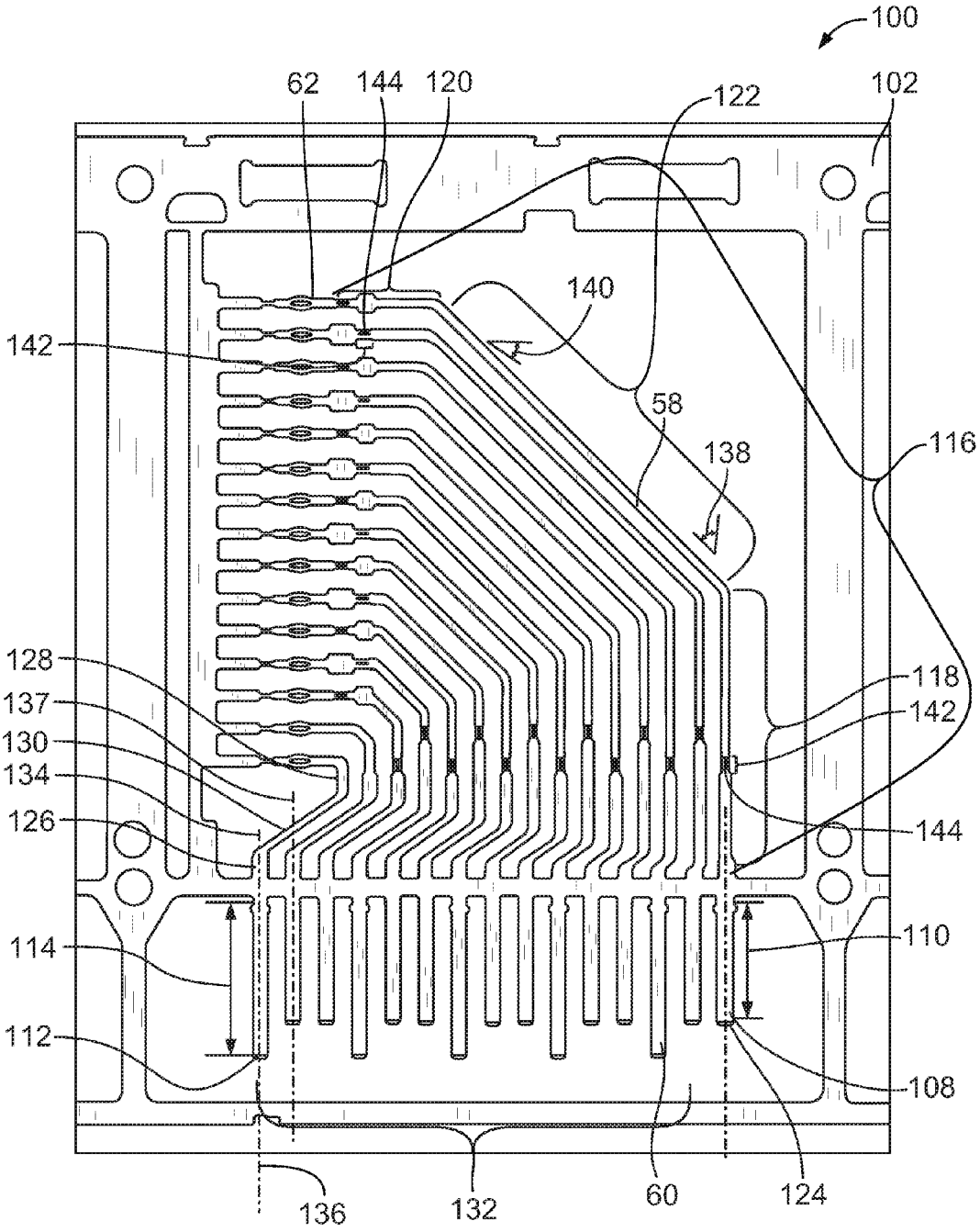
FIG. 2 is a bottom schematic view of a contact carrier assembly formed in accordance with an embodiment.

FIG. 2 illustrates a contact carrier assembly 100 formed in accordance with an embodiment. The contact carrier assembly 100 includes a carrier plate 102 which serves as a frame for the contacts 58 during an initial manufacturing process. The contacts 58 and the carrier plate 102 are stamped and formed from sheet material. Multiple contacts 58 are formed at the same time. The multiple contacts 58 are stamped as blanks from the sheet material. The blanks may be formed into the contacts 58 while remaining connected to the carrier plate 102. The contacts 58 are then separated from the carrier plate 102. Alternatively, the blanks may be removed from the carrier plate 102 prior to forming the contacts 58. After being removed from the contact carrier assembly 100, the electrical contacts 58 may be inserted into the electrical header 50.

Each contact 58 includes a mating end 60 and a mounting end 62. The mating end 60 is configured to extend from the mating end 54 (shown in FIG. 1) of the header housing 52 (shown in FIG. 1). The mounting end 62 is configured to extend from the mounting end 56 (shown in FIG. 1) of the header housing 52. The mating end 60 is oriented at an angle, for example, 90 degrees with respect to the mounting end 62. Alternatively, the mating end 60 may be oriented at any angle, for example, 180 degrees with respect to the mounting end 62.

The mounting end 62 of each contact 58 is formed as an eye-of-the-needle connector. The mounting end 62 is configured to deform when inserted into an aperture in the circuit board 64 to create an interference fit with a wall surface of the aperture. Alternatively, the wall surface of the aperture may deform to receive the mounting end 62 of the contact 58. In another embodiment, both the wall surface of the aperture and the mounting end 62 of the contact 58 deform to create an interference fit between the mounting end 62 of the contact 58 and the circuit board 64. In one embodiment, the mounting end 62 of the contact 58 may be formed as any suitable connector, for example, a pin, post, a hollow connector configured to receive a pin, post, or the like. In one embodiment, the mounting end 56 of the header housing 52 may include an engagement mechanism that engages a corresponding mechanism on the circuit board 64 to retain the mounting end 62 of the contact 58 in engagement with a corresponding conductor of the circuit board 64.

The mating end 60 of each contact 58 is formed as a post configured to be received in a receptacle of the module. Alternatively, the mating end 60 may be formed as an eye-of-the needle connector that creates an interference fit with the receptacle of the module. The mating end 60 may also be formed as any other suitable connector, for example, a pin, post, or the like. In one embodiment, the mating end 54 of the header housing 52 may include an engagement mechanism configured to engage a corresponding mechanism on the module to retain the mating end 60 of the contact 58 within the module.

A plurality of first mating ends 108 have a length 110. A plurality of second mating ends 112 have a length 114. The length 114 is greater than the length 110. Alternatively, the length 114 may be less than the length 110. In another embodiment, the length 114 may be the same as the length 110. A pair of first mating ends 108 is positioned adjacent each second mating end 112. Alternatively, the first and second mating ends 108 and 112 may have any arrangement. The contacts 58 are removed from the carrier plate 102 so that the first and second mating ends 108 and 112 can be arranged in any manner within the header housing 52.

An intermediate portion 116 extends between each mating end 60 and each mounting end 62. The intermediate portion 116 includes an intermediate mating portion 118 and an intermediate mounting portion 120. A transition portion 122 extends between the intermediate mating portion 118 and the intermediate mounting portion 120.

The intermediate mounting portion 120 extends from the mounting end 62. In the illustrated embodiment, the intermediate mounting portion 120 extends axially from the mounting end 62. Alternatively, the intermediate mounting portion 120 may extend at an angle from the mounting end 62.

The intermediate mating portion 118 may extend axially from the mating end 60, as illustrated with respect to contact 124. In another embodiment, the intermediate mating portion 118 may extend at an angle with respect to the mating end 60. Alternatively, the intermediate mating portion 118 may include a first end 126, a second end 128, and an angular section 130 extending between the first end 126 and the second end 128, as illustrated with respect to contacts 132. The first end 126 may extend axially from the mating end 60. The angular section 130 is oriented at 45 degree angles with respect to the first end 126 and the second end 128. The second end 128 extends parallel to a centerline 134 of the first end 126. The second end 128 is oriented parallel to a centerline 136 of the mating end 60. Alternatively, the second end 128 may extend at an angle with respect to the mating end 60.

The transition portion 122 extends at an angle 138 from the intermediate mating portion 118. The transition portion 122 also extends at an angle 140 from the intermediate mounting portion 120. In the illustrated embodiment, the transition portion 122 extends 45 degrees with respect to both the intermediate mating portion 118 and the intermediate mounting portion 120. The transition portion 122 extends at angles 138 and 140 so that the mating end 60 is oriented 90 degrees with respect to the mounting end 62. In one embodiment, the transition portion 122 extends at any angles 138 and 140 with respect to the intermediate mating portion 118 and the intermediate mounting portion 120, respectively, so that the mating end 60 is oriented at 90 degrees with respect to the mounting end 62. In an embodiment where the mating end 60 and the mounting end 62 are oriented at an angle other than 90 degrees, the angles 138 and 140 are configured to create the desired angle between the mating end 60 and the mounting end 62.

The intermediate mating portion 118 includes a shield attachment area 142. The intermediate mounting portion 120 includes a shield attachment area 142. In one embodiment; only one of the intermediate mating portion 118 and the intermediate mounting portion 120 include a shield attachment area 142. In another embodiment, the transition portion 122 may include a shield attachment area 142.

A shield is configured to join the shield attachment area 142 to shield the contact 58 from electromagnetic interference. The shield attachment area 142 is configured to remain exposed and does not include an insulative cover. Exposing the shield attachment area 142 enables an electrical connection between the shield attachment area 142 and the shield. The shield attachment area 142 includes a notch 144 formed therein. The notch 144 is formed during stamping and forming of the contact 58 to provide uniform dimensions to the shield attachment area 142. The uniform dimensions of the shield attachment area 142 allow the shield attachment area to be isolated from insulation when the contact 58 is over-molded. In one embodiment, the notch 144 may be formed on any location of the contact 58.

Figure 3:
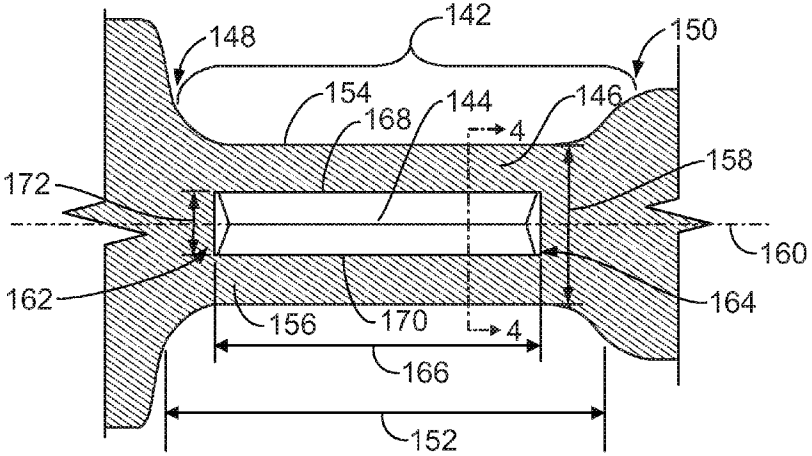
FIG. 3 is a bottom view of a shield attachment area formed in accordance with an embodiment.

FIG. 3 illustrates a bottom 146 of the shield attachment area 142. The bottom 146 of the shield attachment area 142 includes the notch 144. Alternatively, the notch 144 may be formed on a top (not shown) of the shield attachment area 142. The shield attachment area 142 includes a front end 148 and a back end 150. The shield attachment area 142 includes a centerline 160 extending from the front end 148 to the back end 150. A length 152 of the shield attachment area is defined between the front end 148 and the back end 150 along the centerline 160. The shield attachment area 142 includes a first side 154 and a second side 156. A width 158 of the shield attachment area 142 is defined between the first side 154 and the second side 156. In the illustrated embodiment, the width 158 of the shield attachment area 142 increases at both the front end 148 and the back end 150 of the shield attachment area 142. In another embodiment, the shield attachment area 142 may have a uniform width 158 between the front end 148 and the back end 150.

The notch 144 extends along the centerline 160 of the shield attachment area 142. Alternatively, the notch 144 may extend parallel to the centerline 160. In one embodiment, the notch 144 may extend at an angle to the centerline 160. The notch 144 includes a front end 162 positioned proximate to the front end 148 of the shield attachment area 142. The notch 144 includes a back end 164 positioned proximate to the back end 150 of the shield attachment area 142. The notch 144 has a length 166 defined between the front end 162 and the back end 164. The length 166 of the notch 144 is less than the length 152 of the shield attachment area 142. Optionally, the length 166 of the notch 144 may be the same as the length 152 of the shield attachment area 142. The notch 144 includes a first side 168 and a second side 170. A width 172 of the notch 144 is defined between the first side 168 and the second side 170 of the notch 144. The notch 144 has a uniform width 172 along the length 166 of the notch 144. Alternatively, the width 172 of the notch 144 may vary along the length 166 of the notch 144.

Figure 4:
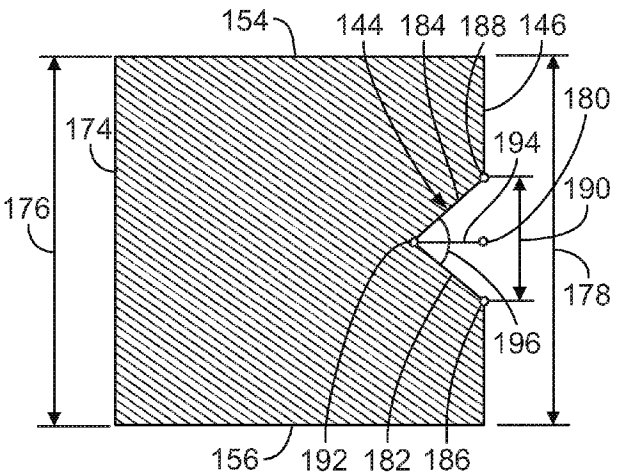
FIG. 4 is a cross-sectional view of the shield attachment area shown in FIG. 3 taken about line 4-4.

FIG. 4 illustrates a cross-sectional view of the shield attachment area 142 taken about the line 4-4 in FIG. 3. The shield attachment area 142 (shown in FIG. 3) includes the bottom 146 and a top 174. The first side 154 and the second side 156 extend between the top 174 and the bottom 146. The first side 154 and the second side 156 extend substantially parallel between the top 174 and the bottom 146. The top 174 has a width 176 and the bottom 146 has a width 178. The width 176 of the top 174 is substantially the same as the width 178 of the bottom 146.

The bottom 146 includes a midpoint 180 centered between the first side 154 and the second side 156. The notch 144 is formed at the midpoint 180 of the bottom 146 of the shield attachment area 142. Alternatively, the notch 144 may be formed at any intermediate location between the first side 154 and the second side 156. The notch 144 is formed with a v-shaped configuration. The notch 144 includes a first side 182 and a second side 184. The first side 182 intersects the bottom 146 of the shield attachment area 142 at a point 186. The second side 184 intersects the bottom 146 of the shield attachment area 142 at a point 188. A width 190 of the notch is defined between the point 186 and the point 188. The first side 182 and the second side 184 of the notch 144 converge at a point 192. The point 192 is aligned with the midpoint 180 with respect to the bottom 146 of the shield attachment area 142. A depth 194 of the notch 144 is defined between the point 192 and the midpoint 180. Alternatively, the point 192 may be offset from the midpoint 180 with respect to the bottom 146 of the shield attachment area 142. The first side 182 and the second side 184 of the notch 144 extend from the point 192 at an angle 196 with respect to each other. In one embodiment, the angle 196 may be 90 degrees. Alternatively, the angle 196 may be 45 degrees. In one embodiment, the angle 196 may be any angle between 0 degrees and 180 degrees.

When the shield attachment area 142 is stamped and formed, the first side 154 and the second side 156 of the shield attachment area 142 are forced together by a press (not shown). The first side 154 and the second side 156 may be non-uniformly formed by the press, thereby causing the width 176 of the top 174 to be greater than the width 178 of the bottom 146. The notch 144 is pressed into the bottom 146 of the shield attachment area 142 to force the first side 154 and the second side 156 outward from the midpoint 180 of the bottom 146. The first side 154 and the second side 156 are forced outward such that the first side 154 and the second side 156 are formed substantially parallel. The notch 144 forms the first side 154 and the second side 156 such that the width 176 of the top 174 is substantially the same as the width 178 of the bottom 146.

By forming the first side 154 and the second side 156 substantially parallel, the shield attachment area 142 can be properly isolated when the contact 58 is over-molded. The panels of a mold used in the over-molding process can be properly aligned with the first side 154 and the second side 156 of the shield attachment area 142. Properly aligning the first side 154 and the second side 156 with the panels of the mold prevents insulation from seeping under the panels and into the shield attachment area 142 during the over-molding process. Isolating the shield attachment area 142 prevents flashing of the insulation that may cause the contact 58 to be discarded.

In an exemplary embodiment, a notch 144 was formed having a depth 194 of 0.0342 mm and a width 190 of 0.0759 mm. The resultant width 176 of the top 174 was 0.2978 mm and the resultant width 178 of the bottom 146 was 0.2942 mm. The difference between the width 176 of the top 174 and the width 178 of the bottom 146 was 0.0036 mm.

In another embodiment, a notch 144 was formed having a depth 194 of 0.0307 mm and a width 190 of 0.0686 mm. The resultant width 176 of the top 174 was 0.3024 mm and the resultant width 178 of the bottom 146 was 0.2867 mm. The difference between the width 176 of the top 174 and the width 178 of the bottom 146 was 0.0157 mm.

In another embodiment, a notch 144 was formed having a depth 194 of 0.0358 mm and a width 190 of 0.0733 mm. The resultant width 176 of the top 174 was 0.3068 mm and the resultant width 178 of the bottom 146 was 0.2845 mm. The difference between the width 176 of the top 174 and the width 178 of the bottom 146 was 0.0223 mm.

In another embodiment, a notch 144 was formed having a depth 194 of 0.0452 mm and a width 190 of 0.0945 mm. The resultant width 176 of the top 174 was 0.297 mm and the resultant width 178 of the bottom 146 was 0.2988 mm. The difference between the width 176 of the top 174 and the width 178 of the bottom 146 was 0.0018 mm.

In another embodiment, a notch 144 was formed having a depth 194 of 0.0465 mm and a width 190 of 0.0952 mm. The resultant width 176 of the top 174 was 0.3012 mm and the resultant width 178 of the bottom 146 was 0.2932 mm. The difference between the width 176 of the top 174 and the width 178 of the bottom 146 was 0.008 mm.

In another embodiment, a notch 144 was formed having a depth 194 of 0.0465 mm and a width 190 of 0.0952 mm. The resultant width 176 of the top 174 was 0.3036 mm and the resultant width 178 of the bottom 146 was 0.3019 mm. The difference between the width 176 of the top 174 and the width 178 of the bottom 146 was 0.0017 mm.

It should be noted that the above examples are exemplary only. The above examples are intended to be illustrative, and not restrictive.

Figure 5:
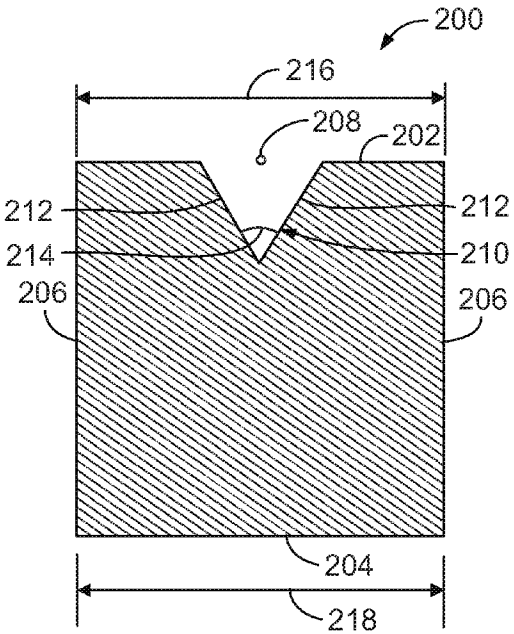
FIG. 5 is a cross-sectional view of an alternative shield attachment area formed in accordance with an embodiment.

FIG. 5 illustrates a cross-sectional view of an alternative shield attachment area 200 formed in accordance with an embodiment. The shield attachment area 200 includes a top 202 and a bottom 204. The top 202 has a width 216 and the bottom 204 has a width 218. A pair of opposed sides 206 extend between the top 202 and the bottom 204. The top 202 includes a midpoint 208 centered between the sides 206.

A notch 210 is formed in the top 202 of the shield attachment area 200. The notch 210 is formed at the midpoint 208 of the top 202. Alternatively, the notch 210 may be formed at any intermediate location between the sides 206. The notch 210 has a v-shaped configuration. Alternatively, the notch 210 may be rounded or have any configuration suitable for aligning the sides 206 of the shield attachment area 200. The notch 210 includes sides 212 that extend at an angle 214 with respect to one another. The angle 214 may be any angle between 0 degrees and 180 degrees. The notch 210 aligns the sides 206 of the shield attachment area 200 such that the width 216 of the top 202 is substantially the same as the width 218 of the bottom 204. The notch 210 aligns the sides 206 such that the sides are substantially parallel.

Figure 6:
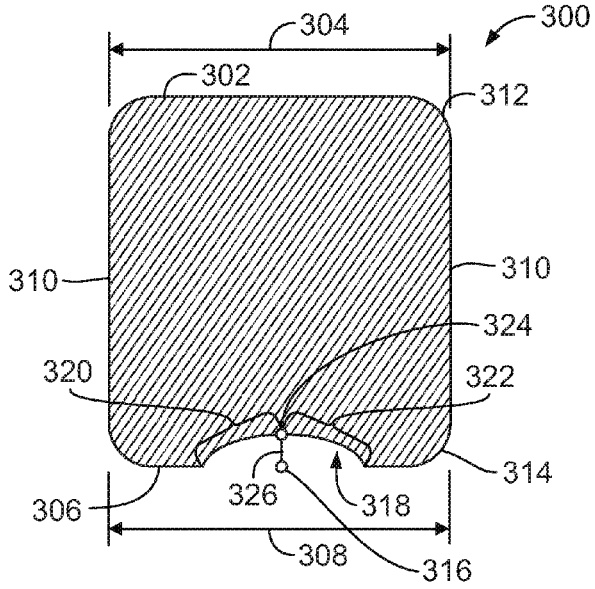
FIG. 6 is a cross-sectional view of another shield attachment area formed in accordance with an embodiment.

FIG. 6 illustrates a cross-sectional view of another shield attachment area 300 formed in accordance with an embodiment. The shield attachment area 300 includes a top 302 having a width 304 and a bottom 306 having a width 308. A pair of opposing sides 310 extends between the top 302 and the bottom 306. The top 302 intersects each side 310 at a corner 312. The bottom 306 intersects each side 310 at a corner 314. In the illustrated embodiment, the corners 312 and 314 are rounded. In another embodiment, only one of the corners 312 or 314 is rounded. The corners 312 and 314 may have a radius 0.05 mm. Alternatively, the corners 312 and 314 may have any suitable radius. In another embodiment, the corners 312 and 314 may have any other suitable configuration. For example, the corners 312 and 314 may include an edge angled with respect to the sides 310 and the top 302 or bottom 306, respectively.

A notch 318 is formed in the bottom 306. In another embodiment, the notch 318 may be formed in the top 302 of the shield attachment area 300. The notch 318 is centered with respect to the sides 310. The notch 318 is formed with an arcuate configuration. The notch 318 includes a first side 320 and a second side 322. A midpoint 324 of the notch 318 is formed centrally between the first side 320 and the second side 322. The bottom 306 includes a midpoint 316 centered between the sides 310. The midpoint 324 of the notch 318 is aligned with the midpoint 316 of the bottom 306. A depth 326 of the notch 318 is defined between the midpoint 324 of the notch 318 and the midpoint 316 of the bottom 306. In another embodiment, the midpoint 324 of the notch 318 is offset from the midpoint 316 of the bottom 306. For example, the notch 318 may be formed at any intermediate location between the sides 310.

The notch 318 includes a radius. The radius of the notch 318 may vary. The radius of the notch 318 is selected to align the sides 310 of the shield attachment area 300. In one embodiment, the radius of the notch 318 is uniform between the first side 320 and the second side 322 of the notch 318. In another embodiment, the radius of the notch 318 varies between the first side 320 and the second side 322 of the notch 318. In an alternative embodiment, the notch 318 does not have an arcuate shape. For example, the notch 318 may be squared, rectangular, or the like.

Figure 7:
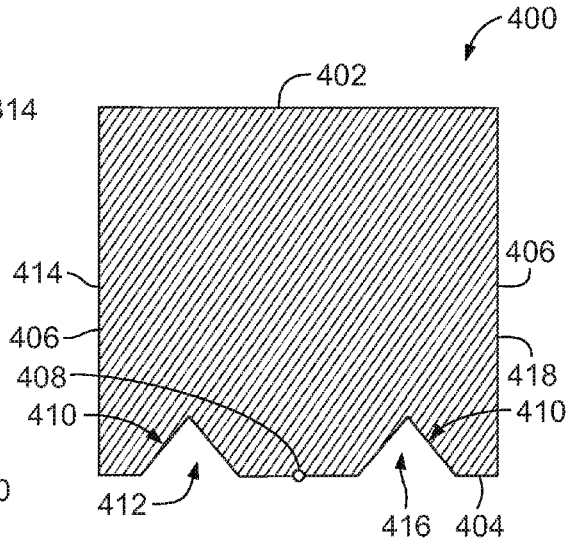
FIG. 7 is a cross-sectional view of another shield attachment area formed in accordance with an embodiment.

FIG. 7 illustrates a cross-sectional view of another shield attachment area 400 formed in accordance with an embodiment. The shield attachment area 400 includes a top 402, a bottom 404, and a pair of sides 406 extending between the top 402 and the bottom 404. The bottom 404 includes a midpoint 408 centered between the sides 406.

The shield attachment area 400 includes two notches 410 formed on the bottom 404 of the shield attachment area 400. Alternatively, the notches 410 may be formed on the top 402 of the shield attachment area 400. In another embodiment, the shield attachment area 400 includes any number of notches 410 formed on the top 402 and/or bottom 404 of the shield attachment area 400. A first notch 412 is positioned between a first side 414 and the midpoint 408 of the bottom 404. A second notch 416 is positioned between a second side 418 and the midpoint 408 of the bottom 404. Alternatively, the notches 412 and 416 may be formed at any intermediate location between the first side 414 and the second side 418.

Figure 8:
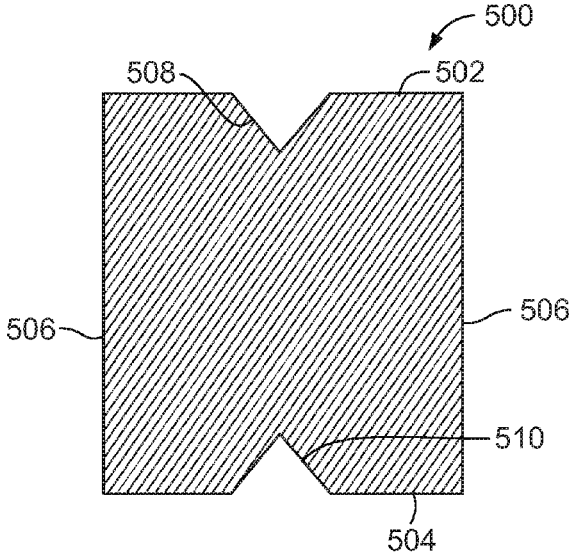
FIG. 8 is a cross-sectional view of another shield attachment area formed in accordance with an embodiment.

FIG. 8 illustrates a cross-sectional view of another shield attachment area 500 formed in accordance with an embodiment. The shield attachment area 500 includes a top 502, a bottom 504, and a pair of sides 506 extending between the top 502 and the bottom 504. A notch 508 is formed on the top 502 and a notch 510 is formed on the bottom 504. The notches 508 and 510 may be formed at any intermediate location between the sides 506. The shield attachment area 500 may include any number of notches 508 and/or notches 510.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical contact comprising:

a mating end, a mounting end, and an intermediate portion extending between the mating end and the mounting end;

a shield attachment area located on the intermediate portion, the shield attachment area having a top, a bottom, and a pair of sides extending between the top and the bottom, the shield attachment area having a thickness between the top and the bottom, the sides extending in a thickness direction, the shield attachment area being cut by a press in the thickness direction during stamping of the electrical contact to form the sides; and a closed notch formed in at least one of the top or the bottom of the shield attachment area, the notch extending only partially between the top and the bottom, the notch configured to align the pair of sides during stamping and forming of the shield attachment area, the notch aligning the pair of sides such that the sides are in a substantially parallel configuration after being cut by the press, wherein the intermediate portion is configured to be over-molded, the notch aligning the pair of sides to reduce flashing during the over-molding process.

2. The electrical contact of claim 1, wherein the notch is formed at a midpoint of at least one of the top or the bottom of the shield attachment area.

3. The electrical contact of claim 1, wherein the notch is formed in a v-shaped configuration.

4. The electrical contact of claim 1, wherein the notch has a pair of sides formed at an angle of at least 45 degrees, the sides of the notch pressing the sides of the shield attachment area outward after the sides of the shield attachment area are cut by the press.

5. The electrical contact of claim 1, wherein the notch has a depth extending less than half the thickness of the shield attachment area.

6. The electrical contact of claim 1, wherein the shield attachment area is located on the intermediate portion proximate to at least one of the mounting end or the mating end.

7. The electrical contact of claim 1 further comprising a rounded corner formed at the intersection of the notch and the at least one of the top or the bottom.

8. An electrical connector comprising:

a housing having a mounting end and a mating end; and a plurality of electrical contacts extending through the housing, each of the plurality of contacts including:

a mating end, a mounting end, and an intermediate portion extending between the mating end and the mounting end, the mating end of each contact extending from the mating end of the housing, the mounting end of each contact extending from the mounting end of the housing, a shield attachment area located on the intermediate portion, the shield attachment area having a top, a bottom, and a pair of sides extending between the top and the bottom, the shield attachment area having a thickness between the top and the bottom, the sides extending in a thickness direction, the shield attachment area being cut by a press in the thickness direction during stamping of the electrical contact to form the sides, and a closed notch formed in at least one of the top or the bottom of the shield attachment area, the notch extending only partially between the top and the bottom, the notch configured to align the pair of sides during stamping and forming of the shield attachment area, the notch aligning the pair of sides such that the sides are in a substantially parallel configuration after being cut by the press, wherein the intermediate portion is configured to be over-molded, the notch aligning the pair of sides to reduce flashing during the over-molding process.

9. The electrical connector of claim 8, wherein the notch is formed at a midpoint of at least one of the top or the bottom of the shield attachment area.

10. The electrical connector of claim 8, wherein the notch is formed in a v-shaped configuration.

11. The electrical connector of claim 8, wherein the notch has a pair of sides formed at an angle of at least 45 degrees, the sides of the notch pressing the sides of the shield attachment area outward after the sides of the shield attachment area are cut by the press.

12. The electrical connector of claim 8, wherein the notch has a depth extending less than half the thickness of the shield attachment area.

13. The electrical connector of claim 8, wherein the shield attachment area is located on the intermediate portion proximate to at least one of the mounting end or the mating end.

14. An electrical connector comprising:

a housing holding at least one contact which has been manufactured by stamping from sheet material, the at least one contact having an exposed portion which is exposed through or beyond the housing, the exposed portion having a top, a bottom, and a pair of sides extending between the top and the bottom, the sides being cut by a press during stamping of the contact, the exposed portion having a notch in at least one of the top and the bottom, the notch extending only partially between the top and the bottom, the notch presses the sides outward after the sides are cut by the press during the stamping of the contact such that the pair of sides are substantially parallel to each other along a length of the notch wherein the intermediate portion is configured to be over-molded, the notch aligning the pair of sides to reduce flashing during the over-molding process.

15. The electrical connector of claim 14, wherein the notch is formed in a v-shaped configuration.

16. The electrical connector of claim 14, wherein the notch has a pair of sides formed at an angle of at least 45 degrees.

17. The electrical connector of claim 14, wherein the notch has a depth extending less than half a thickness of the contact.

18. The electrical connector of claim 14, wherein the press acts in a pressing direction from the top to the bottom, the top being naturally wider than the bottom after the cut, the notch being formed on the bottom to force the sides, at the bottom, outward such that a width of the contact at the bottom is substantially equal to a width of the contact at the top.

19. The electrical connector of claim 14, wherein the housing holds a plurality of the contacts in a contact plane that is parallel to the tops and the bottoms of the contacts, the sides facing each other and the housing being over-molded over the contacts such that material of the housing is between the sides.

20. The electrical connector of claim 14, wherein the sides define sheared surfaces of the sheet material formed by the cut of the press during the stamping and the top and bottom define non-sheared surfaces of the sheet material.

* * * * *